US008714338B2

(12) United States Patent
Matheisl et al.

(10) Patent No.: US 8,714,338 B2
(45) Date of Patent: May 6, 2014

(54) HANDRAIL FOR AN ESCALATOR OR A MOVING SIDEWALK

(75) Inventors: Michael Matheisl, Vösendorf (AT); Thomas Illedits, Neufeld (AT); Thomas Novacek, Schwechat (AT)

(73) Assignee: Inventio AG, Hergiswil NW (CH)

( * ) Notice: Subject to any disclaimer, the term of this patent is extended or adjusted under 35 U.S.C. 154(b) by 241 days.

(21) Appl. No.: 12/993,524

(22) PCT Filed: May 5, 2009

(86) PCT No.: PCT/EP2009/055426

§ 371 (c)(1),
(2), (4) Date: Nov. 19, 2010

(87) PCT Pub. No.: WO2009/141223

PCT Pub. Date: Nov. 26, 2009

(65) Prior Publication Data

US 2011/0067973 A1 Mar. 24, 2011

(30) Foreign Application Priority Data

May 21, 2008 (EP) ..... 08156615

(51) Int. Cl.
*B66B 23/24* (2006.01)

(52) U.S. Cl.
USPC ..... 198/337; 198/335; 198/847

(58) Field of Classification Search
USPC ..... 198/337, 335, 847
See application file for complete search history.

(56) References Cited

U.S. PATENT DOCUMENTS

| | | | | |
|---|---|---|---|---|
| 3,688,889 | A * | 9/1972 | Koch et al. | 198/337 |
| 3,842,961 | A * | 10/1974 | Burson | 198/334 |
| 3,865,225 | A * | 2/1975 | Phal | 198/337 |
| 2007/0045082 | A1 * | 3/2007 | Ishikawa et al. | 198/330 |

FOREIGN PATENT DOCUMENTS

| | | | | |
|---|---|---|---|---|
| DE | 3921887 | A1 * | 1/1991 | B66B 23/24 |

* cited by examiner

*Primary Examiner* — Gene Crawford
*Assistant Examiner* — Matthew Marota
(74) *Attorney, Agent, or Firm* — Ladas & Parry LLP

(57) ABSTRACT

A handrail (2) for an escalator or a moving sidewalk is designed such that the same consists only of a handle rail (3*a*) and a fitted tractive means (91, 9*b*) and has guiding surfaces (11*h*-11*n*) which are complementary to guiding surfaces (5*f*-5*m*) on a top side (7) of the balustrade. The handle rail (3*a*) or a cover of the handle rail (3*a*) is made of tire-resistant, non-flammable, or flame-retardant material.

7 Claims, 8 Drawing Sheets

2c
3c
25a
25b
27a
27b
28a
28b
6c
24
14
4
9c
29a
29b
29c
29d
32

HANDRAIL FOR AN ESCALATOR OR A MOVING SIDEWALK

This application claims the benefit of European Patent Office application 08 156615.0 filed May 21, 2008.

The invention relates to a handrail for a person conveying device in the form of an escalator or a moving walkway.

BACKGROUND OF THE INVENTION

By "handrail" there is understood a device at a balustrade arranged at (one or) both sides of the escalator or moving walkway. A handrail strip or grip strip is guided along this balustrade and, in particular, at the same speed at which the escalator or moving walkways moves. The grip strip thereby offers support or a handhold for a person located on the conveying device or getting on or off this.

As essential component of a person conveying device—public facilities such as, for example, railway stations or department stores come to mind—a handrail has to fulfil not only a high level of functional capability, but also high safety demands.

A handrail usually comprises traction means with the help of which it is drawn through a guide by a drive. The guide runs along a balustrade arranged at (one or) both sides of the escalator or moving walkway. The traction means, but also the handrail itself, has to be flexible or consist of elements so that circulation, in the manner of an escalator, around the balustrade can be described. This circulation is composed of various curves and semicircles or semi-ellipses as well as looping of drive wheels.

The laid-open specification DE 2 203 178 discloses a handrail cons sting of four main individual parts. A traction means was to be designated first main individual part. It preferably consists of a steel band. Secondly, a profile member which is C-shaped in cross-section and which consists of individual segments in its longitudinal direction. The segments are fixed, but have intermediate spaces so as to be able to describe the curved circulation. These intermediate spaces are formed by a convex end which is disposed opposite a respective concave (rear) side of an adjacent segment. Thirdly, the handrail disclosed in this laid-open specification has a further, approximately rectangular, small profile member. This very short profile member in turn has a toothing: additionally connecting receptacles are attached. The traction carrier is clamped in place between the C-shaped and the approximately rectangular, small profile member by appropriate connecting elements in the C-shaped profile member, which elements are pressed into the receptacles. Fourthly, the handrail disclosed in this laid-open specification comprises a grip strip which encases the C-shaped carrier profile member or profile member.

It is disadvantageous with this handrail arrangement that it consists of so many parts or individual parts. In cross-section there are four individual parts and in longitudinal section there are many small, narrow individual pieces so that bending along the circulation path is ensured. So many individual parts lead, however, not only to high increased costs or assembly costs, but also to a high outlay on assembly on site. If it is sought to reduce the number of individual parts by selecting fewer longitudinal pieces, then the buckle loading of the traction means increases and the bending stiffness by degrees, which has a consequence of diminished curve guidance and semicircle guidance or a generally worse capability of guidance.

Proceeding from the handrail arrangement described in this laid-open specification DE 2 203 178 the object is set of creating a person conveying device with a handrail which does not have the described disadvantages. A handrail should be created which is, in addition, of more economic and is improved ergonomically and in terms of gripping. Moreover, it should maintain or even surpass the required safety demands.

BRIEF DESCRIPTION OF THE INVENTION

The inventor recognised that the guide surfaces conventionally formed between the balustrade upper side and a guide profile member can also be formed between the balustrade upper side and the grip strip itself. In accordance with the invention the guidance of the handrail is integrated in the grip strip. The handrail can—considered in cross-section—in this manner be reduced to merely two individual parts: a grip strip and a traction means.

Moreover, in accordance with the invention the grip strip is in production so injected or cast or injection-moulded or, however, also extruded that it encloses the traction means in mechanically positive manner. This mechanically positive enclosure can be such that the traction means has projections and depressions which are mechanically positively enclosed by the (for example, injection-moulded) grip strip and corresponding recesses. However, pure surface fusion—without the just-described projections and recesses—during injecting and/or casting or extruding or pultrusion is itself to be understood in this case as a mechanically positive enclosure.

One possible embodiment of a grip strip according to the invention even dispenses with the traction means, but then, however, has to be produced from a material or a material compound which on the one hand is itself very tension-resistant and flexible and on the other hand still so stable that the drive of the handrail no longer functions by drawing by way of the traction means, but, for example, by way of a roller drive.

As already mentioned above, the grip strip can, for example, be injection-moulded. In this connection it can be injection-moulded or cast from a plastics material, which enables production—in its longitudinal direction—not only from individual segments, but also from a single piece. In this construction the traction means has to be extremely flexible and enable easy deflection. Coming into consideration in this regard is a form of manufacture which is already connected at the factory at its seam position and is delivered as a finished grip-strip ring to the assembly site. However, also coming into consideration is manufacture at the outset of a ring and not an open grip-strip band having to be later closed to form a grip-strip ring. In addition, however, assembly on site also comes into question, for example by means of an overlapping connection which does not protrude and which ensures a smooth connecting point. The latter is required particularly on the grip-strip upper side so that there is no risk of injury to persons being transported.

The grip strip can—as seen in its cross-section—be made from a single material as a solid or semi-solid or hollow or, however, also partly hollow profile member braced by webs. In this connection, the selected material represents a merging or fusion of advantageous or more advantageous characteristics so as to simultaneously fulfil the required or desired or objective material requirements as satisfactorily as possible.

In the case of a longitudinally integral design variant the material has to be flexible in order to be able to describe the bends and curves of the circulation. At the same time, however, it also has to be supple so that the bends and the alternating loading in bending do not cause cracks. In the case of a roller drive the material has to have a sufficient rubbing strength which withstands the thrust of the driving roller/ rollers. The guide surfaces must be wear-resistant, abrasion-resistant and hard and have good sliding properties. The grip surface has to be haptically pleasant and allow secure gripping.

A preferred embodiment of a grip strip according to the invention thus envisages better satisfaction of the partly contradictory material demands in that a grip strip was created which is indeed of integral construction in its cross-section as before, but consists of a material compound with two, three or more materials. This can be, for example, two or three different kinds or variants of plastics material which are so injection-moulded in a common injection-moulding method that, for example, the guide surfaces consist of a highly abrasion-resistant plastics material with very good sliding capability and the remaining cross-sectional profile of the grip strip is formed from a flexible and haptically pleasant plastics material. Suitable as a wear-resistant plastics material compatible with sliding is, inter alfa, PAS®-LXY plastic of the company Faigle of Hard, Austria. However, PTFE or Teflon or polytetrafluoroethylene or POM-PTFE 18 Silc2, PA6.6 PTFE 18 Silc2, PA6-PTFE 13 Silc2, PA6.6 PTFE20, PA12 PTFE 18 Silc2, PPS PTFE15 GF30, PAI PTFE20, PPSO PTFE20, PPSU PTFE20, PPE PTFE18, POM-PTFE 18, POM-PTFE 20, POM PFTE25, etc., are also suitable. In general, it is preferred in accordance with the invention to make use of a material having a coefficient of friction in a range of 0.05 to 0.35, preferably 0.10 to 0.15. In general, use is preferably made of polytetrafluoroethylene (PTFE) (e.g. TEFLON®) plastics material or polytetrafluoroethylene plastics material and/or NANO slide lacquers or NANO slide synthetic materials or NANO slide parts or NANO slide particles.

A further preferred embodiment of a grip strip according to the invention provides a material compound of three or more different materials. In this regard, the guide surfaces can consist of a Teflon slide material as described above, but the base body region of the grip strip of a material which optimally fulfils the structural demands (reverse bending properties, tensile strength) and the circumferential region or cover region of the grip strip again of a soft and haptically pleasant material. The grip-strip base body region is preferably made of a plastics material having a bending strength in a range of 30 to 185 $N/mm^2$, preferably 50 to 95 $N/mm^2$, values of 15 to 30 $N/mm^2$ also being conceivable.

With respect to the material properties of the cover region of a grip strip according to the invention selection is made of haptically pleasant materials, preferably material with soft-touch surfaces and/or foam skin surfaces. This means on the one hand that the tactile sensation on contact does not generate any excessive stimuli. This concerns, for example, roughness, hand slide characteristics, temperature and thermal conductivity, but, also the capability of absorbing moisture and grease. On the other hand, however, the cover region of the grip strip must satisfy safety demands. Relevant in this connection are, in particular, flame protection characteristics or fire protection characteristics and slip characteristics of the material. If the material is too slippery, then there is too little grip in the inclined part of the escalator. If, thereagainst, it is too slip-resistant, then risks of accident and handling problems are involved, for example with articles of clothing or pieces of luggage sticking thereto. The grip-strip cover layer is preferably made of a different plastics material having a roughness in a range of 0.4 to 8 microns, preferably 2 microns, and/or a specific thermal conductivity $\lambda$ in a range of 0.05 to 0.5 W/mK, preferably 0.2 to 0.3 W/mK.

In principle, the following materials can be considered for a grip strip according to the invention: plastics materials such as, for example: PA (polyamide), PA6 (ultramid polyamide, e.g. PERLON®), POM (polyoxymethylene, e.g. DELRIN®), PEEK (polyetheretherketone), PAS (polyarylenesulfide), PE (polyethylene), PUR (polyurethane), PP (polypropylene), PVDF (polyvinylidenefluoride), PTFE (polytetrafluoroethylene); natural fibres or fibre compounds or GRP (glassfibre-reinforced plastic) or CRP (carbonfibre-reinforced plastic) or press cement or fibre matrix or Polytron or prepregs (pre-impregnated fibres) or injection-moulded ceramic or hemp cement or recycled material or combinations of the listed materials.

Moreover, it is envisaged to construct a grip strip according to the invention, whether it consists of only one material or a material compound, from fireproof or 'self-extinguishing' materials. Coming into consideration is PAS-PVDF of the company Faigle of Hard, Austria, or here, in particular, a plastics material of the name WYTEX® of the company Monahan Filaments of Middlebury, Vt., USA. The material may be also chosen to be chloride or fluoride-free, or in the event of ignition to not release or emit any inert gases, sulphur dioxide, sulphurous acid, ammonia, nitrogen oxide, nitric acid, sulphuric acid, soot, hydrocyanic acid, hydrogen cyanide, hydrogen fluoride, hydrogen chloride, hydrogen bromide, hydrogen iodide, any nitrous substance, or any nitrous gas.

The materials of the grip strip—all three materials or, in particular, the material of the cover layer—can additionally in accordance with the invention fulfil the following subsidiary objectives:

- prevention of static electricity,
- noise insulation,
- cold and heat insulation,
- maintenance of hygienic measures or hygiene requirements, with respect to good cleaning and keeping clean, but also the possibility of disinfecting and possible penetration of the material by nano-silver particles, and, in addition, a selective making reflective or chroming or metallisation of the cover material.

International patent publication WO-A2-2006/010181 discloses an improvement of fire resistance of a grip strip of a handrail for an escalator or a moving walkway by the application of a coating to the grip strip and not the production of the grip strip itself from a fireproof or self-extinguishing material. Which materials or substances yield an improved fireproof coating is not disclosed.

The cross-sectional profile of a grip strip according to the invention can be of ergonomically improved construction in that, for example, convexities and depressions adapt better to a resting hand surface and, for example, to the enclosing thumb. A preferred embodiment envisages offering enhanced gripping possibility for children in that a strip of smaller diameter and better grippable from below is integrated in the grip strip.

The surface of the grip strip can be constructed to be rough, smooth, corrugated or knurled. Moreover, it can be coated, painted or coloured or constructed as a PVD surface ('Physical Vapour Deposition'=physical gas-phase deposition), as a metallised (for example, vapour-deposited with chromium) surface, or as a DLC ('Diamond-like Carbon'=diamond-like protective layer of carbon) or plasma surface or nano surface.

In addition, in accordance with a further preferred embodiment of a handrail according to the invention the surface has guide flutes in the form of grooves into which corresponding mating guides or flanges or lateral guides on the rollers fit. A person conveying device according to the invention thus comprises, in a preferred embodiment, a handrail circulation which is guided at the balustrade upper side by the mechanically positive interengagement of mutually complementary guide surfaces, but the handrail is supported at the underside of the balustrade by rollers. At least one of these rollers is designed as a guiding roller. The drive of the handrail can take place by way of one or more wheels. A friction wheel is preferred particularly when the traction means is cast in place in the handrail strip and thus serves only as reinforcement, or a variant of embodiment of a handrail without a separate traction means is concerned. Apart from guiding rollers or rollers, however, other return guides are also conceivable and in addition not only—as similarly described—at the balustrade underside itself, but also in a base region of the balustrade or thereunder, recessed in the region of the support structure or framework of the escalator or moving walkway.

With regard to guidance of the handrail strip/grip strip at the balustrade upper side, as already mentioned mechanically positively interengaging and complementary guide surfaces are formed in accordance with the invention at the balustrade upper side and at the grip strip. This means that the balustrade upper side itself is, in a minimalistic version, constructed as a rectangle having three guide surfaces. The then—correspondingly—also only three complementary guide surfaces of the grip strip so enclose the balustrade that the grip strip lies on the upper surface of the balustrade and the lateral surfaces give lateral guidance support.

A preferred embodiment of a handrail guide according to the invention, however, provides that the grip strip cannot be laterally displaced by means of application of force (against the flange of the guiding roller or roller). For this purpose, further guide surfaces are provided which interengage in the manner of a groove-and-key connection.

According to the invention it is also possible to provide a handrail guide which has guide surfaces, which are vertically supporting as well, only at the side surfaces of the balustrade. This embodiment has, in particular, the advantage that an intermediate space can be left between the grip-strip lower side and the balustrade upper side, so that the speed of circulation of the handrail cannot reduce if, for example, a person supports themselves firmly or places a heavy item of luggage thereon.

A further preferred embodiment of a handrail guide according to the invention provides, in order to avoid reductions in speed due to increased coefficients of friction, small rollers or needle bearings or needle-roller flat belts or cylinder-roller flat belts in the guide surfaces.

The afore-described embodiments of handrail strips according to the invention disclosed a construction of the balustrade upper side itself with guide surfaces. However, it is also conceivable to form the balustrade upper side without guide surfaces and to mount a guide rail thereon.

Regardless of whether the balustrade upper side itself is furnished with guide surfaces or a guide rail is mounted thereon the cross-sectional profile of the guide surfaces at the balustrade upper side can be positive or negative. The cross-sectional profile of the guide surfaces at the grip-strip lower side is respectively complementary therewith. The fact that the guide, by contrast to conventional handrail attachments, can also be formed negatively in the balustrade and positively directly in the grip strip opens up the possibility of striving for improved, more secure guides which according to need and the materials employed involve less risk of catching.

A handrail strip according to the invention can, as already explained above, consist longitudinally of one piece or of several segments. In the case of an embodiment with individual segments it is possible to provide the intermediate spaces, which part at the curves or deflection of the handrail strip, with a flexible and reversibly extensible casing. However, a combination of flexible segments together with the flexible and reversibly extensible casing represents a further preferred embodiment. It offers the advantage that the flexibility of the segments does not have to be as high as in the case of the integral grip strip variant without a casing, but at the same time the casing, due to the flexibility of the segments, does not have to cover such widely gaping intermediate spaces.

In accordance with a preferred embodiment of a handrail according to the invention this flexible and reversibly extensible casing is made of a non-combustible material. For this purpose, as already explained above for the grip strip itself (without casing), use is preferably made of the synthetic material WYTEX® of the company Monahan Filaments of Middlebury, Vt., USA. The flame-retardant synthetic materials WYTEX® FR-H and WYTEX®, in particular, do not contain any halogens or phosphorous. These synthetic materials have all advantageous stiffness and strength characteristics of Nylon or polyamide and, in addition, the advantage of a very low toxicity, acidity and smoke optical density. Moreover, the material is self-extinguishing and fireproof and fire-retardant. The inflammability corresponds, in the test of Underwriters Laboratories UL® 94, at 0.75 mm thickness with the class V0 (stated as V-zero). This simply means that a sample of the stated material thickness is fixed vertically and after exposure to an open flame self-extinguishes within less than 10 seconds. Self-extinguishing is thus proven and extreme fire-retardation is given.

In addition, these synthetic materials have marked electrical insulation properties whilst maintaining high mechanical strength. The principal features of the basic material are as follows:

- density 1.16 kg/dm$^3$
- impact toughness according to Izod 40 J/m$^2$
- tear/stretch strength 75 N/mm$^2$
- specific elongation 10%
- bending strength 95 N/mm$^2$
- modulus of elasticity 2300 N/mm$^2$
- creep current strength >400 V and preferably >600 V
- deformation temperature 190 degrees Celsius
- oxygen index 34%
- inflammability rate according to UL® 94 at 0.75 mm corresponds with at least V1, and preferably V0
- toxicity index 38
- smoke optical density 75 (F)/50 (NF) Dm
- acidity of the smoke 8 pH.

The last-described variant of embodiment with segments can, in accordance with the invention, also be furnished without a traction means. In this case a rotatable connection between the segments must exist. This can be ensured by, for example, a web and a coupling or claw closing therearound. However, also very suitable are connections which are realised by a pin and eye as in the case of a bicycle chain.

Reference is expressly made to a possible capability of combining the teaching of this application with the teaching of an application filed at the same time by the same applicant (person conveying device, particularly escalator or moving walkway, with a handrail). Beyond that, a handrail with material characteristics and safety characteristics still further or more or multiply improved is disclosed in further, supplementing applications of the applicant.

BRIEF DESCRIPTION OF THE DRAWINGS

The invention is explained in more detail symbolically and by way of example on the basis of figures.

The figures are described conjunctively and generally. The same reference numerals signify the same components and reference numerals with different indices indicate functionally equivalent or similar components.

Figure 1:
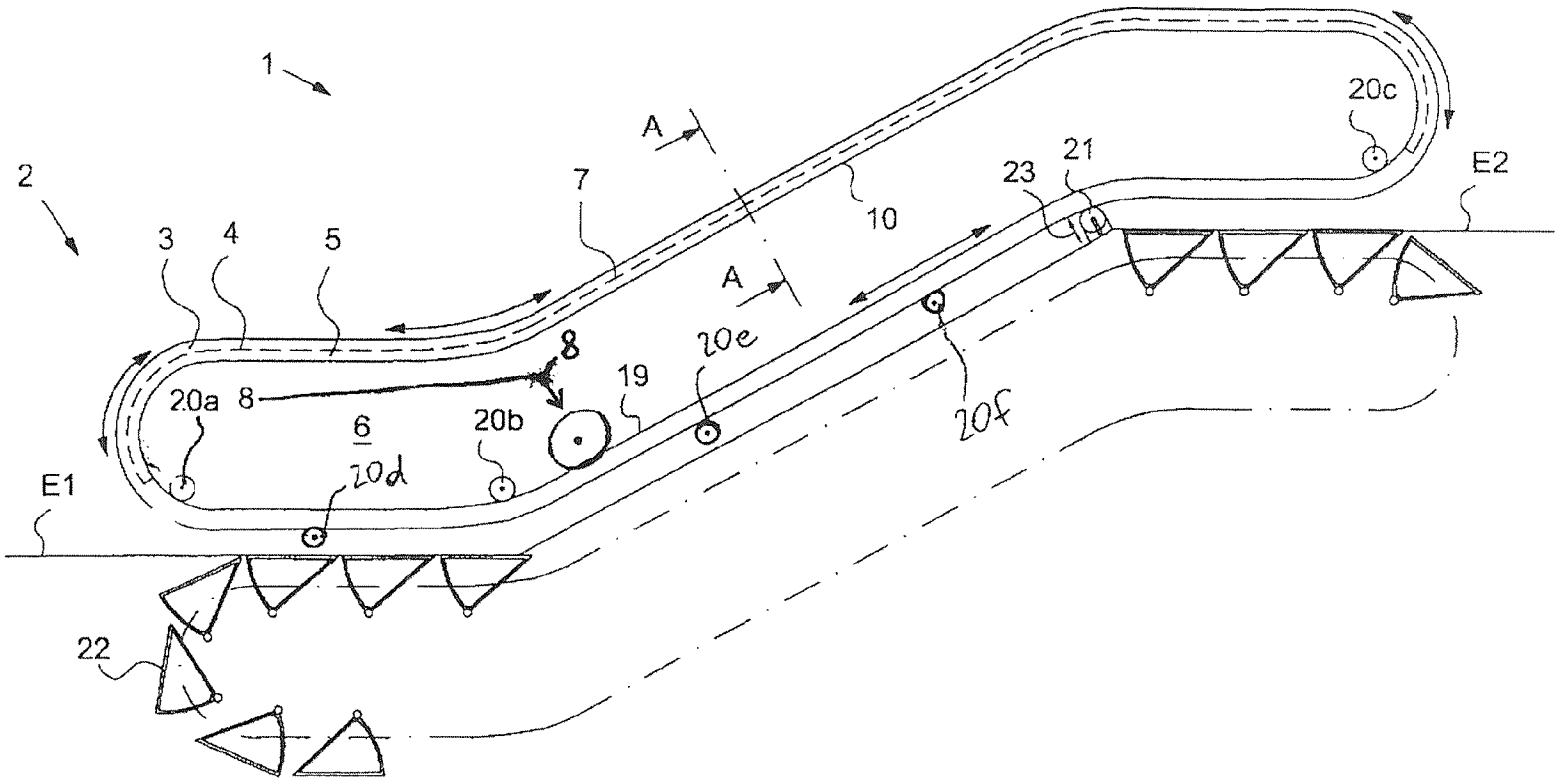
Figure 2:
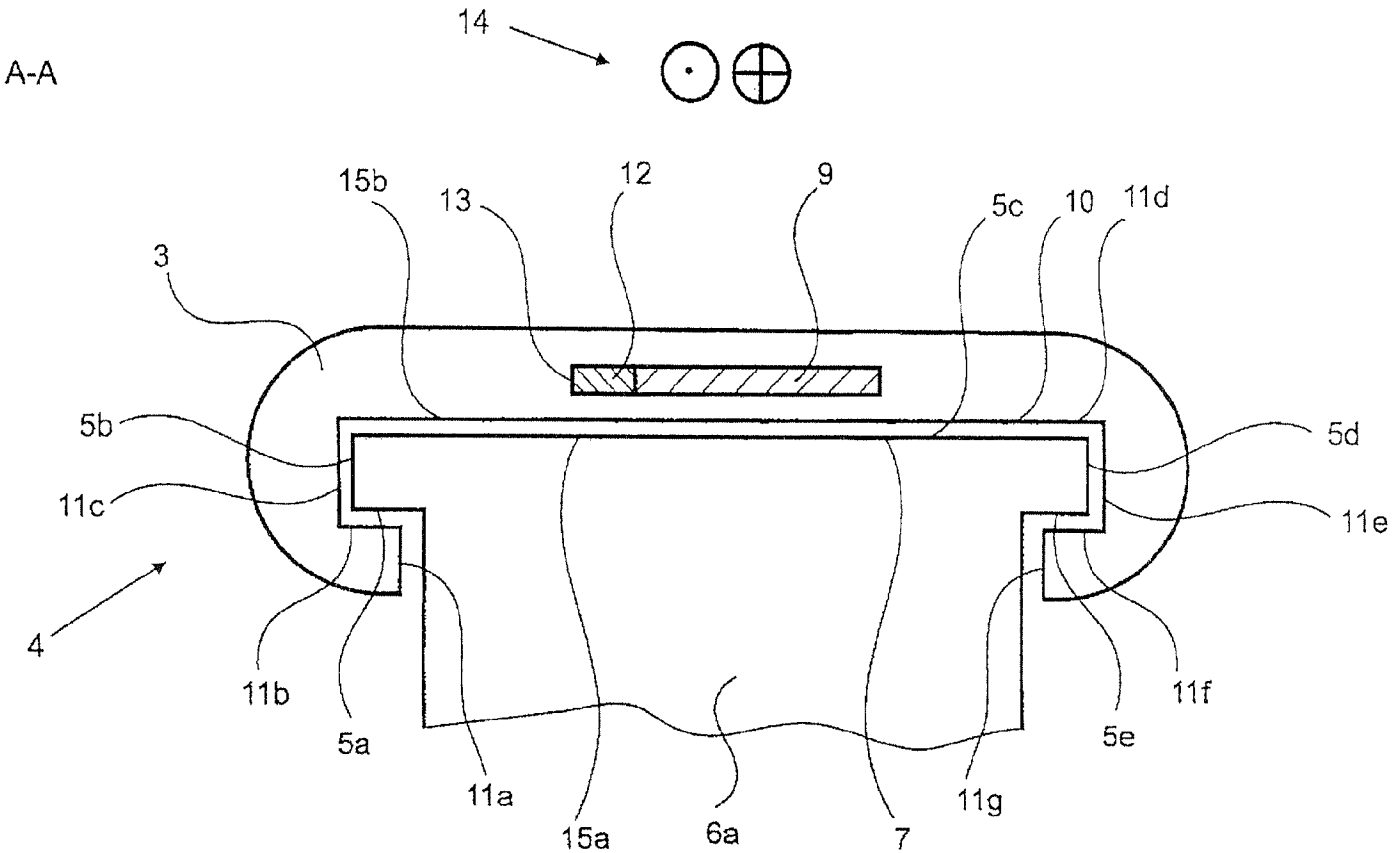
Figure 3:
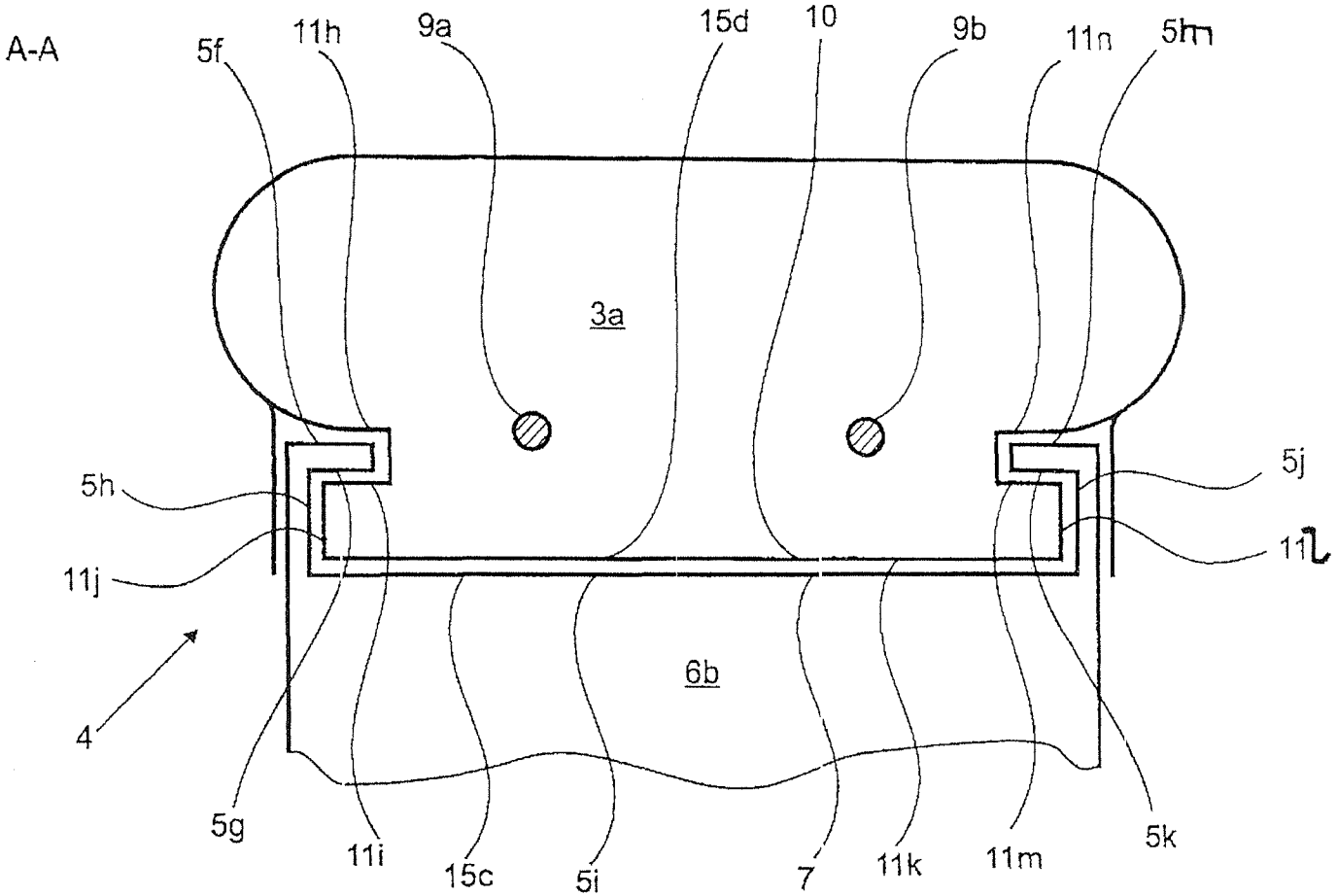
Figure 4:
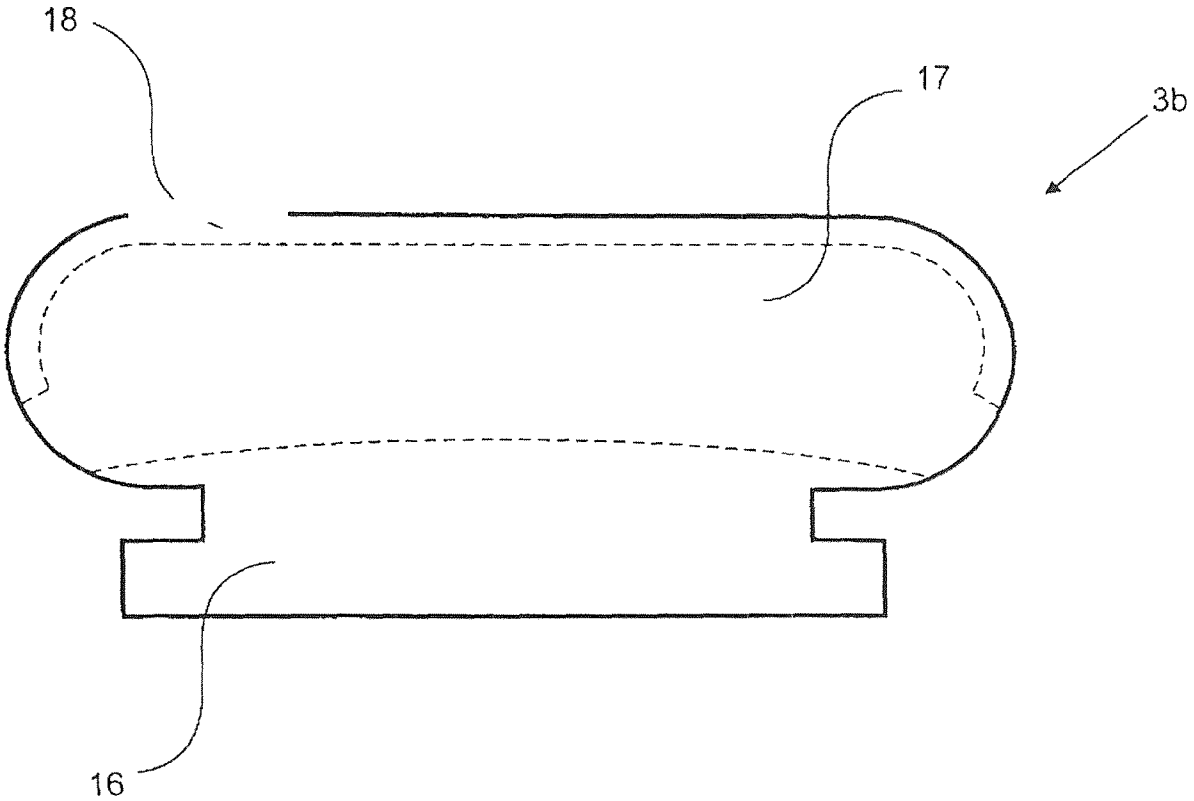

In that case:

FIG. 1 shows a schematic illustration of a person conveying device according to the invention;

FIG. 2 shows a sectional illustration along the section axis A-A of FIG. 1 of a handrail according to the invention;

FIG. 3 shows a sectional illustration along the same section axis A-A of FIG. 1 of an optionally designed handrail according to the invention;

FIG. 4 shows a schematic illustration of a grip strip according to the invention, which is sectioned in cross-section and which consists of a material compound;

FIG. 5 shows a special form of a handrail;

FIG. 6 shows a guide of a specially shaped grip strip by means of guide rollers;

FIG. 7 shows further preferred forms of the grip strip; and

Figure 8:
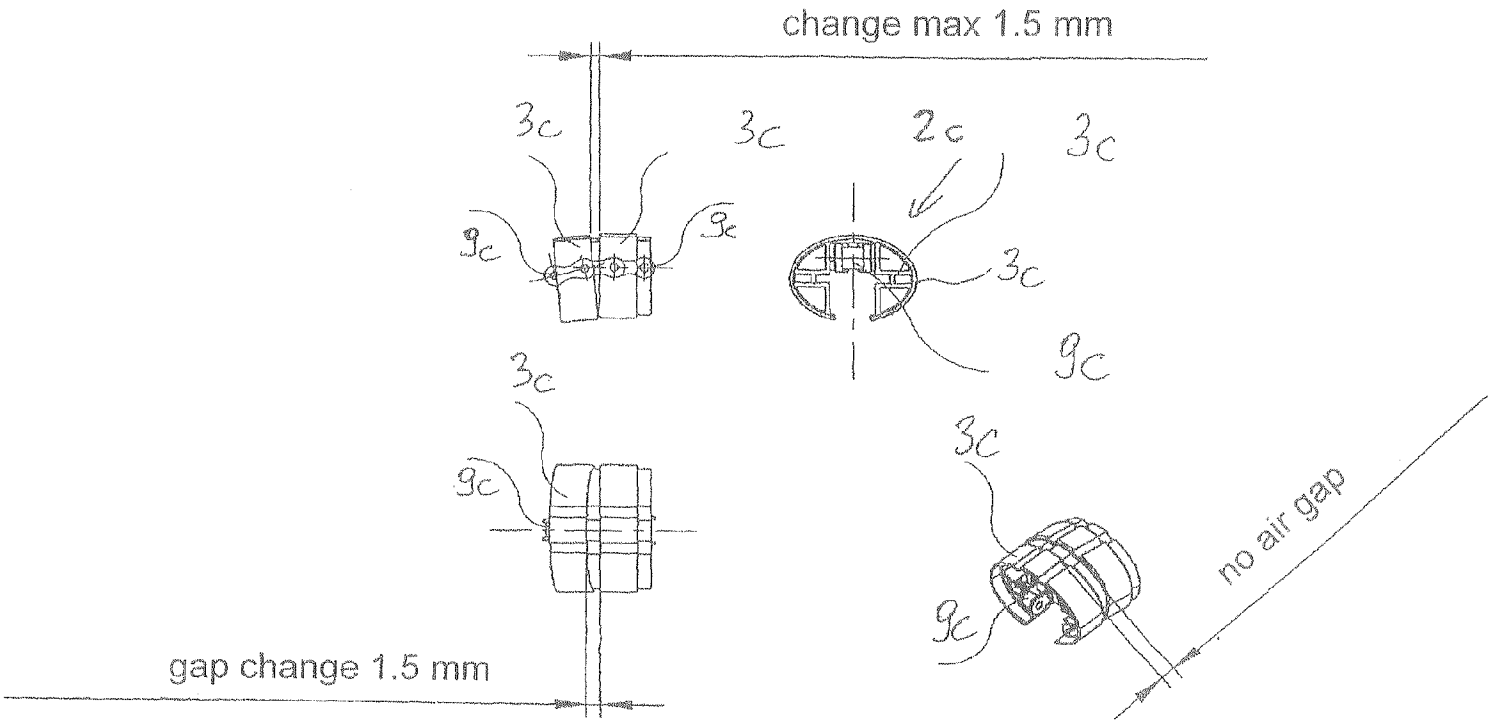

FIG. 8 shows a schematic illustration of the segment gap change in the curve or handrail curve.

DETAILED DESCRIPTION OF THE INVENTION

An escalator is shown in FIG. 1 by way of example for a person conveying device 1 from a highly schematic side view. It conveys persons from a level E1 to a level E2 or conversely. For this purpose it has a substructure consisting of a circulation for individual steps 22 and a superstructure formed substantially from a handrail 2 around a balustrade 6. The handrail 2 is thereby in a position of accompanying an upward and downward movement of the steps 22 in that a grip strip 3 runs along a balustrade upper side 7 in a guide 4 or handrail guide 4 by means of guide surfaces 5 formed at a grip-strip lower side 10. The grip strip 3 is deflected at a balustrade lower side 19 by, for example, rollers 20*a*-20*c*, 21. The return guide of the grip strip 3 is illustrated here by optional rollers at the balustrade lower side. The roller 21 is constructed as a guiding roller to be adjustable in accordance with an adjusting device 23, which is indicated by means of a double arrow. A drive 8 formed from two opposite rollers, of which at least one is driving, rotates the grip strip 3 in the circulation path, which is formed from the guide 4 and the rollers 20*a*-20*f* and 21, respectively in upward or downward transport direction in or against clockwise sense. A section axis A-A is taken through the upper part of the handrail 2 as well as the grip strip 3 and the guide 4 or handrail guide 4.

FIG. 2 schematically shows, as a sectional illustration according to the section axis A-A of FIG. 1, how a guide 4 or handrail guide 4 can be constructed in accordance with the invention, namely in that the balustrade 6*c* at its balustrade upper side 7 forms a positive cross-sectional profile 15*a* in the shape of guide surfaces 5*a*-5*e*. The grip strip 3 or 3*c* is drawn by way of traction means 9*c* in a longitudinal direction 14 into or out of the plane of the sheet, and may have has an oval or elliptical cross-section with a 40 to 70 mm width and 40 to 60 mm height. The traction means 9 has projections in the form of traction carriers 12, which fit in corresponding recesses 13 in the grip strip 3. The grip strip 3 forms at its grip-strip lower side 10, by means of guide surfaces 11*a*-11*g*, a negative cross-sectional profile 15*b*. The balustrade 6*a* is illustrated to be of solid construction, but it can also be hollow or consist only of a vertically disposed plate or sheet or panel or infill panel or panel wall, on the upper edge of which the cross-sectional profile member is seated, which can be constructed like the cross-sectional profile member 15*a*. The traction means can be of various forms of construction, for example: belt, support belt, chain, aramide belt, cogged belt, poly-V-belt, herringbone-cogged belt, transport chain, etc.

FIG. 3 shows, also in correspondence with the section axis A-A of FIG. 1, another embodiment of a guide 4, in which a balustrade 6*b* is so constructed at its balustrade upper side 7 that guide surfaces 5*f*-5*m* form a negatively shaped cross-sectional profile 15*c*. The grip strip 3*a* is formed with guide surfaces 11*h*-11*n* as a positive cross-sectional profile 15*d* and is drawn by two belt parts, chain parts, support belt parts or cogged belt parts 9*a* and 9*b*.

FIG. 4 shows a grip strip 3*b*, which is formed integrally, but consists of a material compound of two or three or more different materials. A grip-strip guide part 16 is formed from one material, a grip-strip base region 17 from another material and a grip-strip cover layer 18 again from a further material having different principal characteristics or protective characteristics, as well as different from the two aforesaid material.

Figures 5A, 5B, 5C:
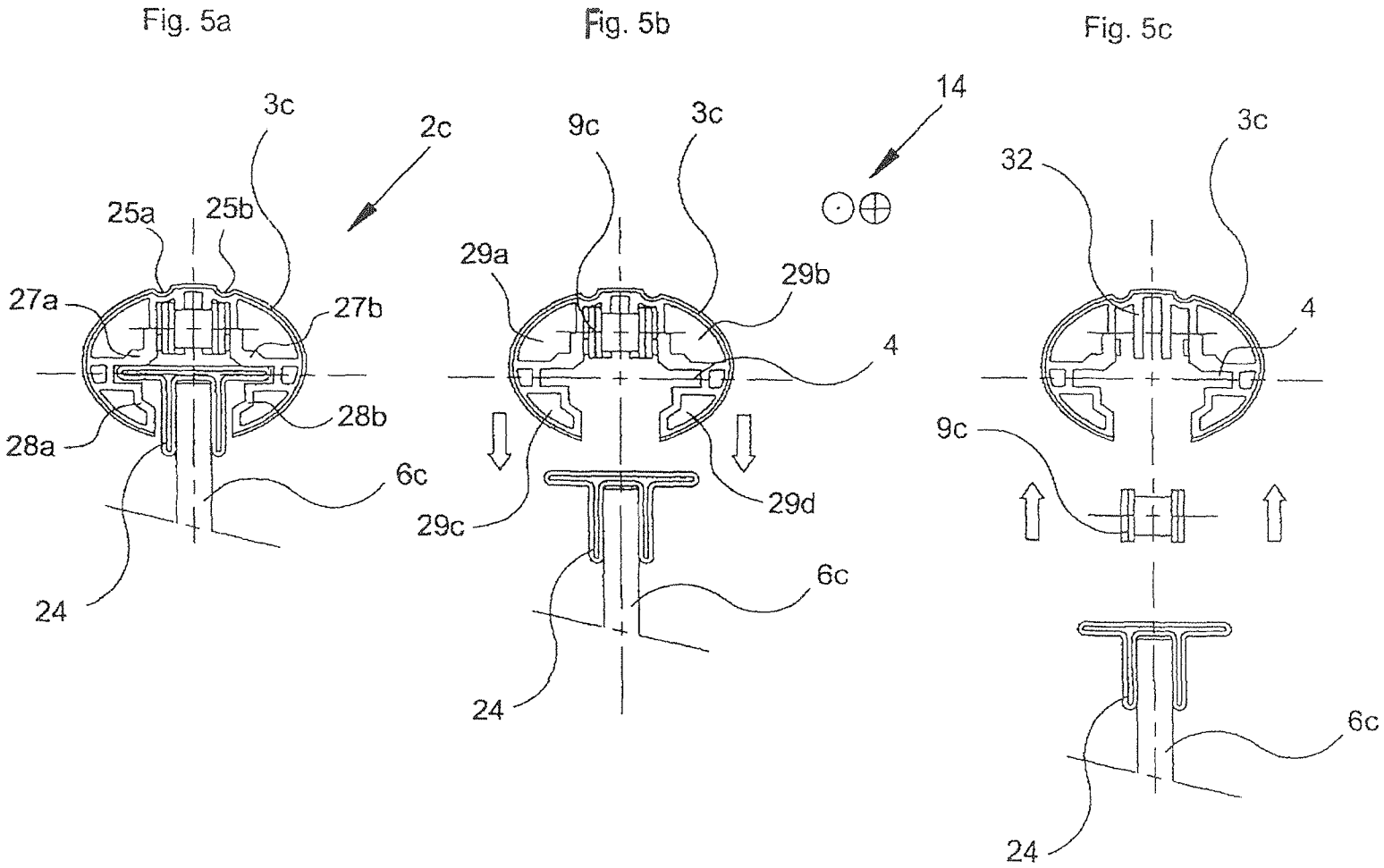

FIG. 5, or generally described FIGS. 5*a* to 5*c*, shows an optional handrail 2*c*, also again in cross-section, according to section axis A-A. Arranged on the balustrade 6*c* is a guide profile member 24 received in the guide 4. The traction means 9*c* is integrated in the grip strip 3*c* by means of a receptacle 32 formed for that purpose. The grip strip 3*c* has optional upper transverse bracing 27*a* and 27*b* and lower transverse bracing 28*a* and 28*b* and spaces 29*a* to 29*d* or cavities. Moreover, two grooves 25*a* and 25*b*, the function of which is discussed in a following figure, can be optionally formed at the upper side of the grip strip 3*c*. The grip strip 3*c* can be pushed or pulled onto the guide profile member 24 in longitudinal direction 14. FIG. 5*c* illustrates how the traction means 9*c* can be easily and simply accommodated in the grip strip 3*c*. The receptacles 32 receive the traction means 9*c* and accommodate it permanently.

Figure 6B:
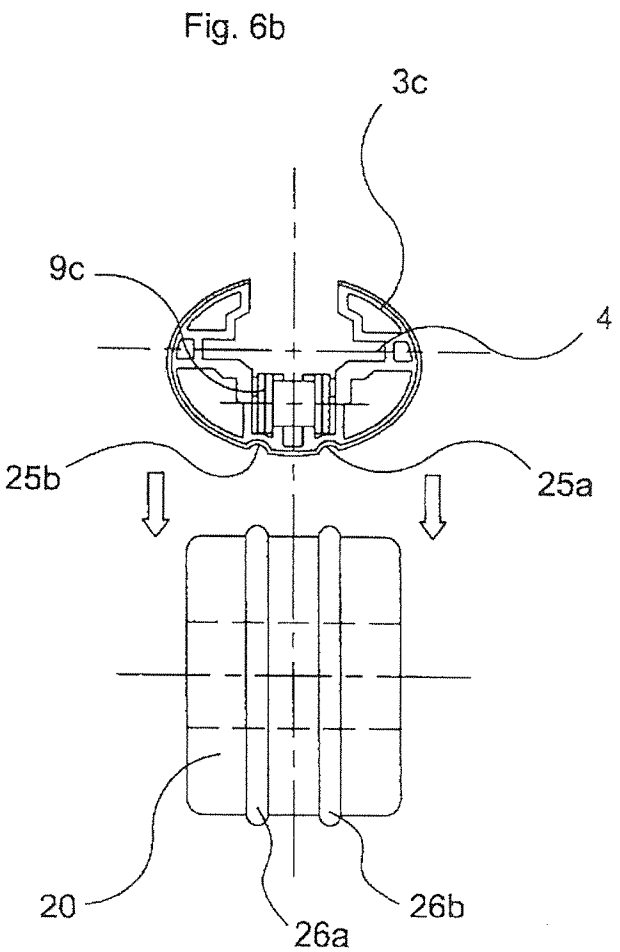
Figure 6A:
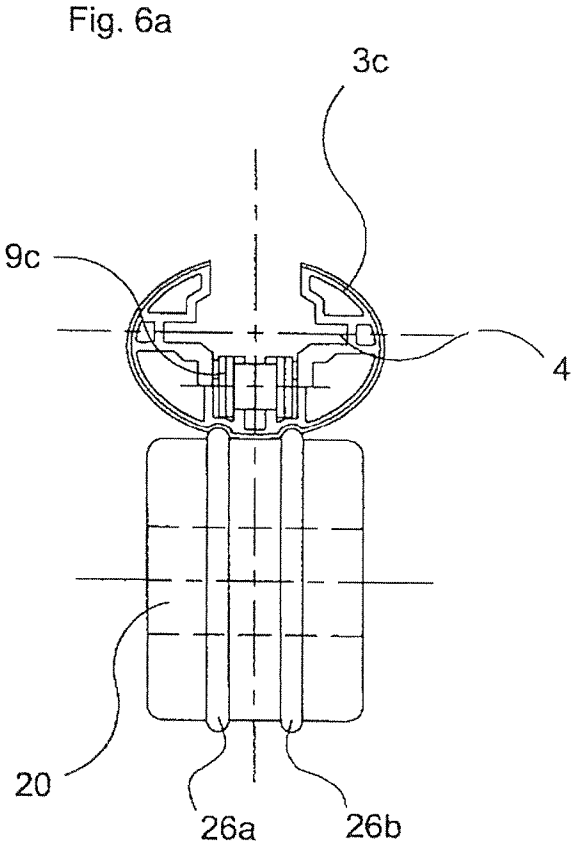

FIG. 6 shows, or FIGS. 6*a* and 6*b* show, the purpose for which the upper side of the grip strip 3*c* has two longitudinally extending grooves 25*a* and 25*b*. In the return guidance of the handrail, thus along the lower side of the balustrade (the grip strip 3*c* is illustrated in mirror image or turned through 180 degrees 'on its head') a handrail according to the invention can be guided by, in particular, guide rollers 20 or guiding rollers 20 and/or also driven. Corresponding flanges or lateral guides 26*a* and 26*b* engage in the grooves 25*a* and 25*b* for better lateral guidance and stability, but also for increasing the contact area.

Figure 7B:
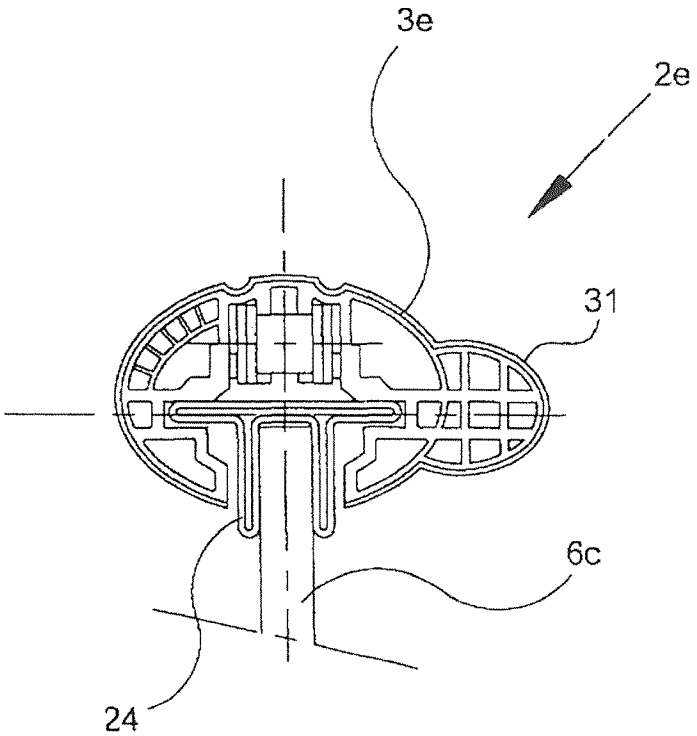
Figure 7A:
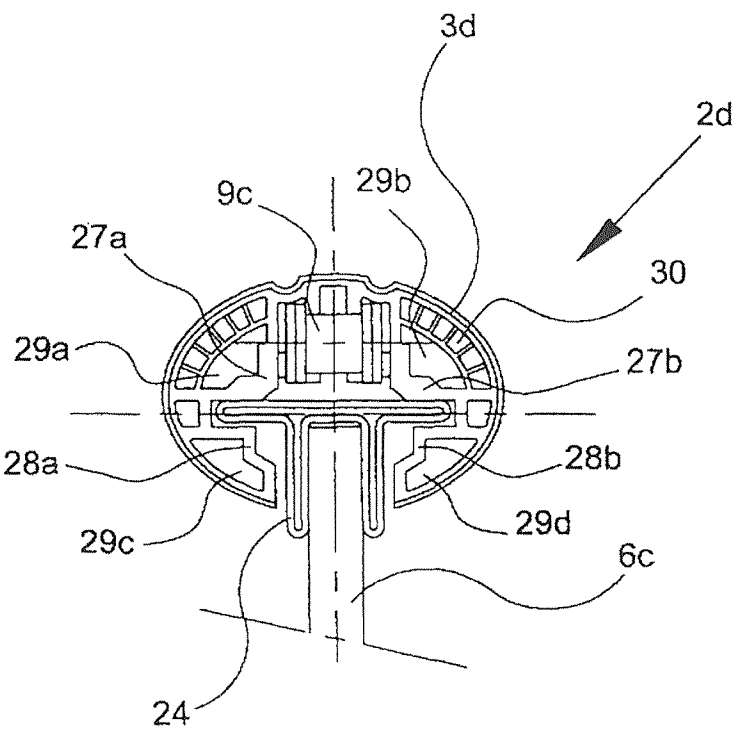

FIG. 7 shows, or FIGS. 7*a* and 7*b* show, additional optional forms of a handrail 2*d* or 2*e*, the grip strips 3*d* and 3*e* having special, differently usable cross-sectional profiles. Shown in FIG. 7*a* is a grip strip 3*d* which also has in cross-section the upper bracing 27*a* and 27*b* and lower bracing 28*a* and 28*b* or the spaces 29*a* to 29*d* or cavities illustrated in FIG. 5, but in addition in the upper region a doubly-reinforced structure and/or double-walled structure with supplementary compartments 30. This embodiment according to the invention brings advantages with respect to stability and material pairings, but also with respect to insulation and damping as well as improved haptics and enhanced grippability. FIG. 7*b* shows, by way of example, a bulge 31 or convexity 31 or child handgrip 31 which is preferably arranged at the inner side of the balustrade 6*c* and which shall, for example, make it possible for children to find a more secure and better grip or hold or holding knob on the hand strip or grip strip.

FIG. 8 shows the tilt change of the individual handrail segments of the grip strip 3*c* of the handrail 2*c* in the handrail deflection region or in the handrail curve. The deviation in angle over the deflection curve of the handrail segments allows a movement change or change in spacing of at most 1.5 mm to 2 mm, i.e. the segment gap change is at most 1.5 mm to 2 mm and the overlap region of the segments is sufficiently dimensioned at 3 mm to 5 mm. Moreover, no form of air gap or opening gap arises, so that there is no risk of being caught or pinched. The traction means 9*c* is of such flexible or resilient or articulated construction that a change in angle or spacing in the curve region or deflection region is possible easily, readily and simply. The necessary fixing or fastening of the individual handrail segments of the grip strip 3*c* on or with the traction means 9*c* is very satisfactorily provided by the receptacle 32. An additional securing of the handrail segments would be possible and conceivable, but can be omitted.

The invention claimed is:

1. A handrail for an escalator or a moving walkway, comprising: a grip strip, a guide with guide surfaces at an upper side of a balustrade, and a drive for moving the handrail along the guide by a traction means, the grip strip comprising layers of at least two different materials with a cover layer only of a self-extinguishing plastic and having a plurality of longitudinally arranged individual segments, each of the segments having interior transversely extending bracings with separate interior cavities, an exterior surface of the cover layer of each segment being formed as one of a group consisting of a physical vapor deposition surface, a metallized surface, a diamond-like carbon layer, a plasma surface, and a nano surface.

2. The handrail according to claim 1, wherein the self-extinguishing plastic does not contain any chlorides, fluorides or halogens or phosphorous.

3. The handrail according to claim 1, wherein the self-extinguishing plastic is chosen from a material of a group that, in the event of ignition does not release or emit any inert gases, sulphur dioxide, sulphurous acid, ammonia, nitrogen oxide, nitric acid, sulphuric acid, soot, hydrocyanic acid, hydrogen cyanide, hydrogen fluoride, hydrogen chloride, hydrogen bromide, hydrogen iodide, any nitrous substance, or any nitrous gas.

4. The handrail according to claim 1, wherein the self-extinguishing plastic material has a bending strength in a range of 30 to 185 $N/mm^2$.

5. The handrail according to claim 1, wherein the self-extinguishing plastic has a creep current resistance of over 400 volts.

6. The handrail according to claim 1, wherein the inflammability rate of the handrail according to Underwriters Laboratories standard UL 94 at a 0.75 mm thickness corresponds to at least class V1.

7. The handrail according to claim 1, wherein the grip strip has an oval or elliptical cross-section with a 40 to 70 mm width and 40 to 60 mm height.

* * * * *